US010450107B2

(12) United States Patent
Martial

(10) Patent No.: US 10,450,107 B2
(45) **Date of Patent: *Oct. 22, 2019**

(54) SACHET HAVING A CONCEALED OPENING

(71) Applicant: S2F FLEXICO, Henonville (FR)

(72) Inventor: Romain Martial, L'Isle Adam (FR)

(73) Assignee: S2F FLEXICO, Henonville (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/772,012

(22) PCT Filed: Oct. 28, 2016

(86) PCT No.: PCT/EP2016/076043

§ 371 (c)(1),
(2) Date: Apr. 27, 2018

(87) PCT Pub. No.: WO2017/072282

PCT Pub. Date: May 4, 2017

(65) Prior Publication Data

US 2018/0312301 A1 Nov. 1, 2018

(30) Foreign Application Priority Data

Oct. 28, 2015 (FR) ..... 15 60314

(51) Int. Cl.
*B65D 33/25* (2006.01)

(52) U.S. Cl.
CPC ..... *B65D 33/2541* (2013.01); *B65D 2215/08* (2013.01)

(58) Field of Classification Search
CPC ..... B65D 33/2541; B65D 33/255
USPC ..... 383/63–65
See application file for complete search history.

(56) References Cited

U.S. PATENT DOCUMENTS 4,878,763 A 11/1989 Ausnit
5,647,100 A * 7/1997 Porchia ..... B65D 33/2508 24/30.5 R
7,340,807 B2 * 3/2008 Dais ..... B65D 33/2541 24/443
7,967,509 B2 * 6/2011 Turvey ..... B65D 33/2508 383/100
7,988,359 B1 8/2011 Sussman et al.
(Continued)

FOREIGN PATENT DOCUMENTS

EP 1712483 A1 10/2006
EP 2420454 A1 2/2012
(Continued)

OTHER PUBLICATIONS

Preliminary Research Report and Written Opinion received for French Application No. 1560314, dated May 30, 2016, 12 pages (1 page of French Translation Cover Sheet and 11 page of original document).

(Continued)

*Primary Examiner* — Jes F Pascua
(74) *Attorney, Agent, or Firm* — Womble Bond Dickinson (US) LLP

(57) ABSTRACT

Sachet having a concealed opening, comprising: a first and a second wall (10, 20), a closure assembly (3) comprising a first and a second support web (30, 32) that are connected to the first and the second wall (10, 20), respectively, and each have a closure element (34).

19 Claims, 7 Drawing Sheets

(56) References Cited

U.S. PATENT DOCUMENTS

| | | | | |
|---|---|---|---|---|
| 9,011,003 | B2 * | 4/2015 | Pawloski | B65D 33/2508 383/61.2 |
| 9,284,097 | B2 * | 3/2016 | Heckman | B65D 33/2508 |
| 9,573,730 | B2 * | 2/2017 | Heckman | B65D 33/2508 |
| 9,957,087 | B2 * | 5/2018 | Takigawa | B65D 33/2508 |
| 10,124,932 | B2 * | 11/2018 | Martial | B65D 33/007 |
| 2009/0245699 | A1 | 10/2009 | Steele | |
| 2012/0045151 | A1 * | 2/2012 | Eouzan | B65D 33/2541 383/42 |
| 2013/0177266 | A1 * | 7/2013 | Mack | B65D 33/01 383/203 |
| 2014/0161374 | A1 * | 6/2014 | Septien Rojas | B65D 33/2508 383/63 |
| 2014/0270585 | A1 * | 9/2014 | Heckman | B65D 33/2508 383/63 |
| 2014/0270586 | A1 * | 9/2014 | Petkovsek | B65D 33/2508 383/63 |
| 2016/0122087 | A1 * | 5/2016 | Takigawa | B65D 33/2508 383/63 |
| 2016/0152382 | A1 * | 6/2016 | Heckman | B65D 33/2508 383/63 |
| 2017/0190476 | A1 * | 7/2017 | Goto | B65D 33/25 |
| 2018/0118414 | A1 * | 5/2018 | Martial | B65D 33/255 |

FOREIGN PATENT DOCUMENTS

| | | | |
|---|---|---|---|
| FR | 1458288 | A | 3/1966 |
| FR | 1553143 | | 1/1969 |
| FR | 2628067 | B1 | 1/1992 |
| FR | 2963927 | A1 | 2/2012 |
| GB | 1116460 | A | 6/1968 |
| GB | 2458645 | A | 9/2009 |
| JP | 2000-072156 | A | 3/2000 |
| WO | 02/74645 | A2 | 9/2002 |
| WO | 2009/130177 | A1 | 10/2009 |
| WO | 2012/075007 | A1 | 6/2012 |
| WO | 2013/076120 | A1 | 5/2013 |

OTHER PUBLICATIONS

International Search Report and Written Opinion received for PCT Patent Application No. PCT/EP2016/076043, dated Dec. 13, 2016, 21 pages (10 pages of English Translation and 11 pages of Original Document).

International Preliminary Report on Patentability received for PCT Patent Application No. PCT/EP2016/076043, dated May 11, 2018, 16 pages (9 pages of English Translation and 7 pages of Original Document).

* cited by examiner

SACHET HAVING A CONCEALED OPENING

FIELD OF THE INVENTION

The present invention relates to the field of packaging bags.

More precisely, the present invention relates to the field of packaging bags comprising opening/closing means, for example and nonlimiting in the form of complementary profiles.

TECHNOLOGICAL BACKGROUND

Many packaging bags and many closing devices for this purpose have already been proposed.

The majority of closing devices known for this purpose comprises two complementary profiles, for example of male/female type or of velvet/hook type, or again of complementary hook type, carried by respective support webs.

Document FR 2 628 067 particularly proposed a bag comprising two main walls comprising two complementary closure profiles carried by respective support webs fixed respectively to the walls. The attachment zone of the support web on the wall is not superimposed on the male profile but rather offset from it so as to hinge the corresponding support web on the wall at the attachment zone. As is described in document FR 2 628 067, the foregoing arrangement avoids internal pressure to the bag from being applied to the closure profiles and tends to separate the latter. In fact, the separation of the walls of the bag (to open the latter) results in possible pivoting of the support web at the hinge zone formed by its attachment, without risk of separation of the closure profiles.

Bags responding to this arrangement have already provided major service and make reopening of the bag difficult, so as to ensure its user that its contents cannot be taken out easily.

Document FR 2 963 927 also proposes that the two attachment zones of the webs are located at a distance from and on either side of the corresponding complementary profiles in such a way that one of the hinged webs is directed towards the inside of the bag, whereas the other hinged web is directed towards its mouth.

These bags also resist internal and external stresses of the walls of the bag, to such a point where today it proves very difficult to open it without damaging the closure device or the walls of the bag.

But in some cases, it can prove necessary to be able to open the bag without damaging it to access its contents and be sure of reclosing it after opening.

Such a bag for example applies to the field of packaging harmful products, such as dishwasher tablets. In fact, it is important to be able to ensure users that the bag stays closed between two uses, especially to prevent children accessing its contents, and letting parents open and reclose the bag several times without risking damaging it, and preferably without successive openings and closings being too difficult.

SUMMARY OF THE INVENTION

An objective of the invention is therefore to propose a bag comprising opening/closing means, for example and without limitation in the form of complementary profiles, and having a system allowing such opening/closing means to be opened easily. If necessary, when the opening means are hinged on one and/or the other of the walls of the bag, the system must allow an adult to open a bag despite the hinge effect generated by the joint.

To this end, the invention proposes a bag comprising:

a first and a second wall connected together so as to define the lateral sides and a bottom of the bag, a closure assembly comprising a first and a second support web respectively connected to the first and the second wall and each including a complementary closure element, the first support web has an upper edge and a lower edge, the lower edge being closer to the bottom of the bag than the upper edge, the bag being characterized in that the upper edge is discontinuously connected to the first wall of the bag and in that:

the upper edge of the first support web is continuously fixed on the first wall along a first section and is continuously separated from said first wall along a second section, and the lower edge of the first support web is continuously fixed on the first wall along the second section over all or a portion of its height, so as to provide at least one passage between this first support web and the first wall of the bag from the outside of the bag, said passage allowing a local deformation of the first support web capable of modifying the local relative orientation of the closure elements during a spacing of the walls of the bag and facilitating the separation of the complementary closure elements.

Some preferred though nonlimiting features of the bag described hereinabove are the following, taken individually or in combination:

the lower edge of the first support web is continuously connected to the first wall between the lateral sides of the bag, the first support web is divided into a lower portion and an upper portion, the lower portion being closer to the bottom than the upper portion and carrying the closure element, and wherein the upper portion of the first support web is discontinuously connected to the first wall so as to provide the passage, the first support web is divided into a lower portion and an upper portion, the lower portion being closer to the bottom than the upper portion and carrying the closure element, and wherein the upper portion of the first support web is locally cut out so as to provide the passage, the passage has a length, in the direction extending between the sides of the bag, comprised between 12 mm and 35 mm, the second support web is hinged on the second wall so that tension on the walls of the bag when the complementary closure elements are engaged causes rotation of the support webs around said complementary closure elements, the second support web is fixed on the second wall in a localized zone which is not superimposed with the closure element and which is offset with respect to said closure element so that the second support web is hinged on the second wall, the second support web is divided into a lower portion and an upper portion, the lower portion being closer to the bottom than the upper portion and carrying the closure element, and wherein the localized zone at which the second support web is fixed on the second wall is part of the lower portion of said second support web, the upper portion of the second support web has a height less than a height of the closure element, the first and the second support web are connected to the first and second walls through a first and a second extension web, respectively, at least one of the support webs being fixed to the extension web at a distance from its upper edge, the at least one support web is fixed to the corresponding extension web in a zone adjacent to the complementary closure element carried by said support web, the bag further comprises an additional wall having a first panel and a second panel, the first panel being connected to the second wall in proximity to the mouth of the bag while the second panel is connected to the first wall, said additional wall being folded between the first panel and the second panel along a fold so that the first panel extends towards the bottom, and wherein the first support web is further fixed on the second wall, and the second support web is further fixed on the second panel of the additional wall, the second panel of the additional wall is fixed in proximity to the lateral edges of the first wall, between the second support web and the fold, the complementary closure elements each comprise at least one complementary profile, preferably at least two complementary profiles, for example between three and six complementary profiles, and/or all or part of the complementary profiles comprise sequential alterations substantially parallel to the lateral sides, typically sequential crushings.

BRIEF DESCRIPTION OF THE DRAWINGS

Other features, aims and advantages of the present invention will emerge more clearly from the following detailed description and with respect to the appended drawings given by way of nonlimiting examples, wherein.

DETAILED DESCRIPTION OF ONE EMBODIMENT

Figure 1:
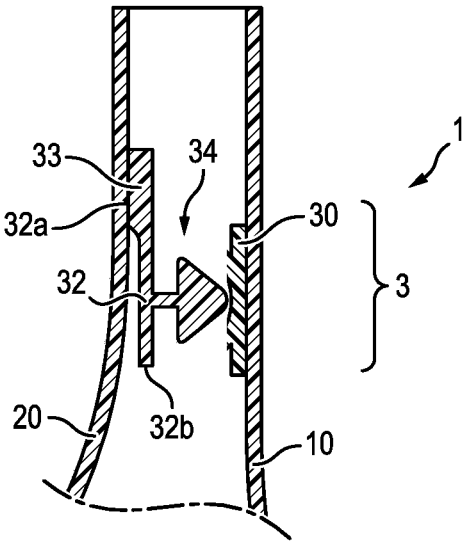
FIG. 1 illustrates a view in transversal crosssection of a first embodiment of a bag according to the invention, the bag being at rest.

A bag 1 comprises, in a manner that is itself conventional, a first and a second wall 10, 20 connected together so as to define lateral sides and a bottom 2 of the bag 1, as well as a mouth, extending opposite its bottom 2.

The bag 1 can be made by means of a single sheet folded back on itself and welded on two sides, or several sheets, for example two sheets welded together at their sides, preferably along ridges connecting the walls and forming the lateral sides and the bottom 2 of the bag 1.

The bag 1 further comprises a closure assembly 3. The closure assembly 3 extends in proximity to the mouth.

The closure assembly 3 comprises a first and a second support web 30, 32 respectively connected to the first and the second wall 10, 20. Each support web 30, 32 carries at least one complementary closure element 34, for example of the complementary profile, velvet/hook strip type, etc.

The first support web 30 has an upper portion 30*a* and a lower portion 30*b*, the upper portion 30*a* being closer to the mouth of the bag 1 than the lower portion 30*b*. Moreover, the lower portion 30*b* carries all or part of the closure element 34.

In order to allow a local deformation of the first support web 30 capable of modifying the relative local orientation of the closure elements 34 during spreading of the walls of the bag 1 and facilitating the opening of the closure assembly 3, the first support web 30 is discontinuously connected over its length to the first wall 10 of the bag 1 so as to allow at least one passage between this first support web 30 and the first wall 10 of the bag 1, from the outside of the bag 1.

Figure 7:
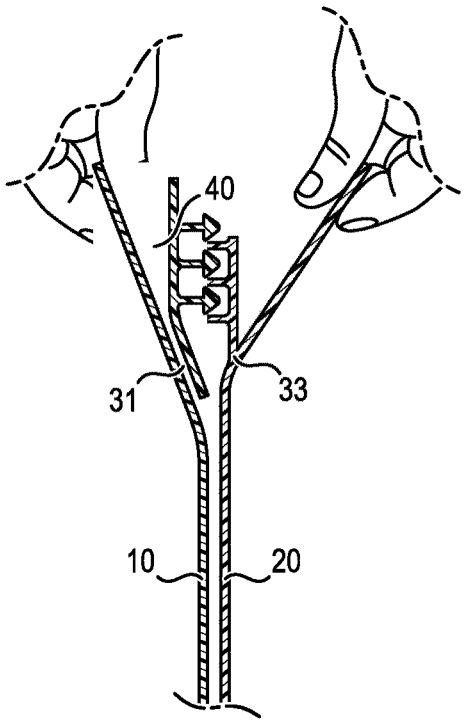
FIG. 7 is a view in crosssection of the bag of FIG. 6*a*, along the axis BA illustrated in FIG. 6*a*, when a user inserts one of his thumbs in the passage and places the other of his thumbs along the second wall.
Figure 8A:
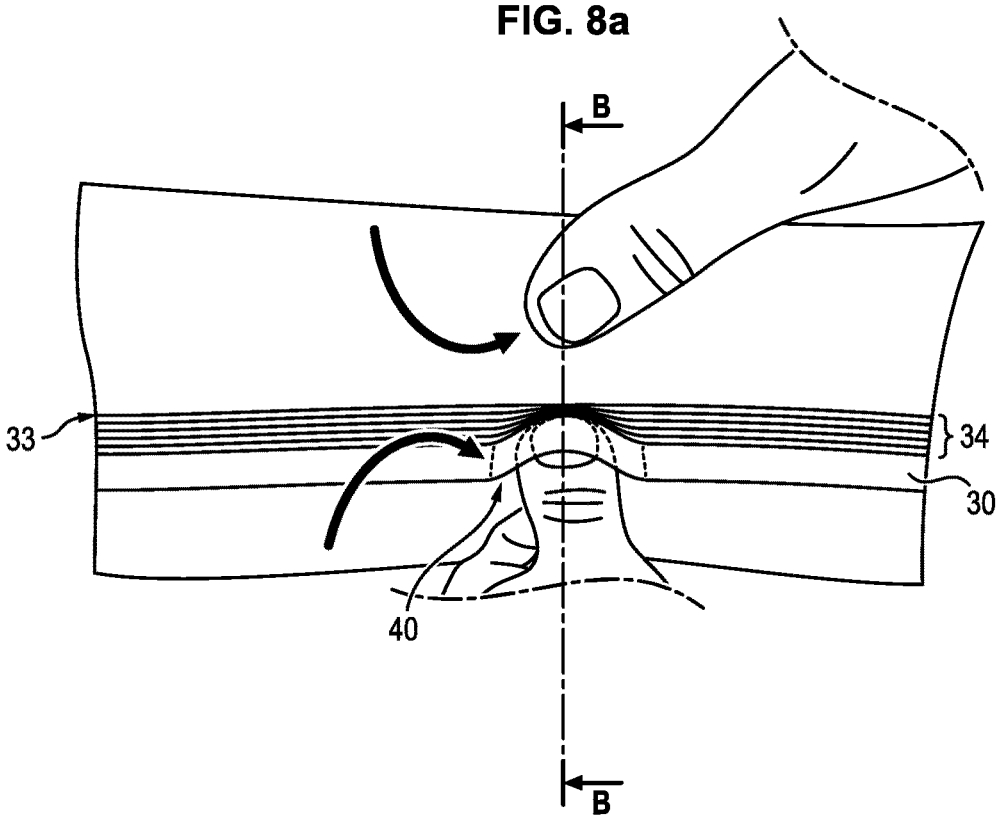
FIG. 8*a* is a top view of the bag of FIG. 6*a* when a user uses the passage and is just at the point of separating the closure elements.

This configuration is particularly advantageous in the case of a bag 1 of which the closure assembly 3 is difficult to open, such as a closure assembly 3 hinged over at least one of the walls of the bag 1, but also finds application when the closure assembly 3 is conventional (not hinged). In fact, to open the closure assembly 3, it is sufficient for the user:

to insert one of his thumbs from the outside of the bag 1—or through the mouth—so as to grip the second wall 20, preferably in proximity to the closure element 34 of the second support web 32, to insert his second thumb in the mouth of the bag 1 in the passage 40 formed between the first wall 10 and the first support web 30 (see FIG. 7). In this position, the support webs are substantially parallel to one another, and to separate the walls by applying force on said walls using the first thumb and the second thumb shown in FIG. 8*b* which extends substantially perpendicular to the plane of the closure assembly 3 (see FIGS. 8*a* and 8*b*).

Figure 8B:
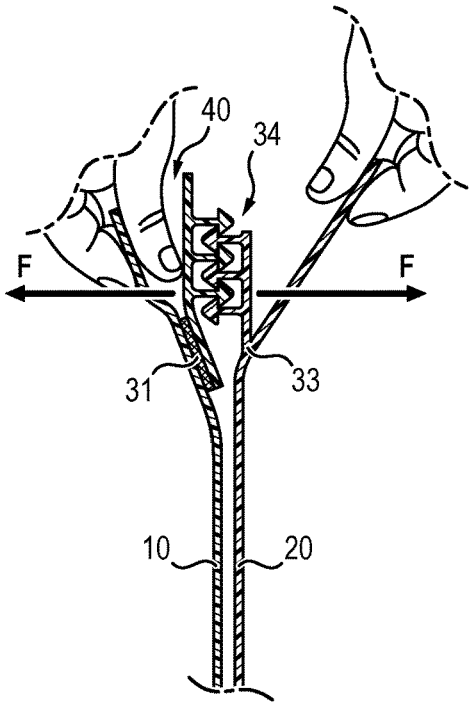
FIG. 8*b* is a view in crosssection of the bag of FIG. 8*a*, along the axis BB illustrated in FIG. 7.
Figure 9:
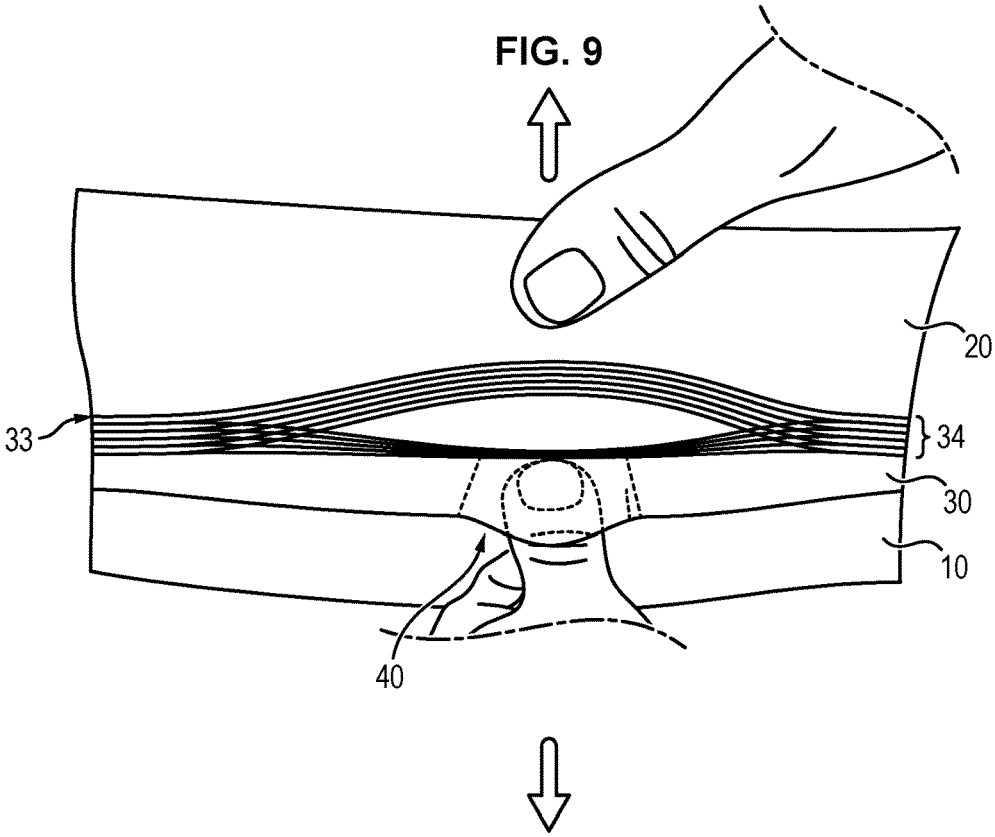
FIG. 9 is a top view of the bag of FIG. 6*a* when the closure elements are in the process of being separated.

In practice, the passage 40 allows locating the point of application of the force at the closure element 34 of the first support web 30, or even of the lower portion of the first support web 30 (depending on the height of the passage 40) (see FIG. 8*b*). In this manner, in cases where the second support web 32 is hinged, during a spacing of the walls, the gripping of the first wall 10 behind the first support web 30 serves to limit the rotation of the closure assembly 3 and therefore bringing closer together to the separation direction the force application direction on the closure elements 34.

Figure 6A:
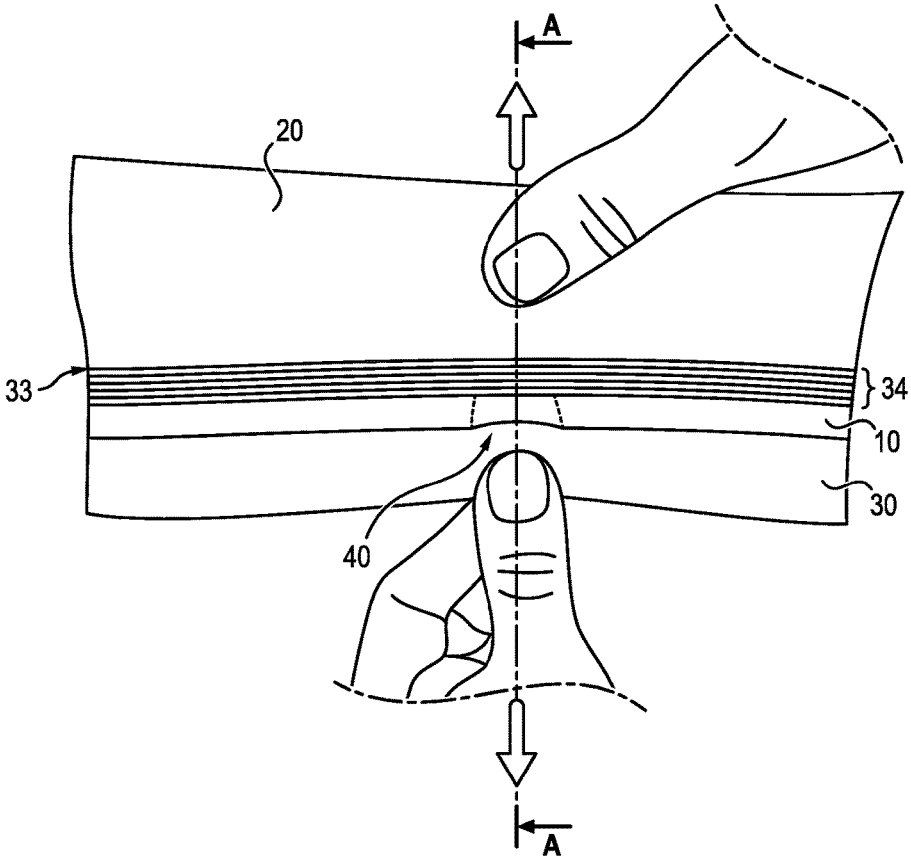
FIG. 6*a* is a top view of a variant embodiment of the first exemplary embodiment of a bag according to the invention, comprising the easy opening of FIG. 5, when a user attempts to open the bag in the conventional manner.
Figure 6B:
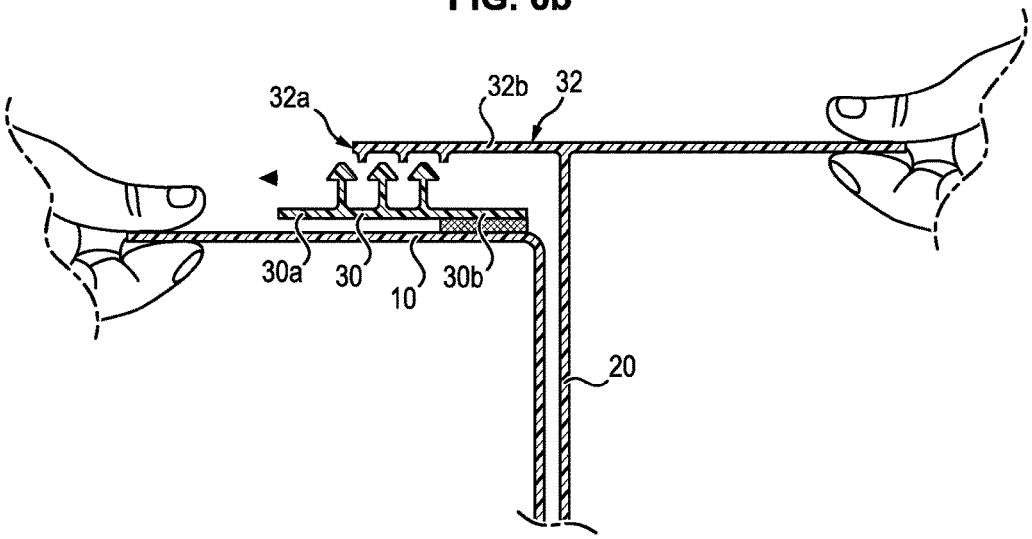
FIG. 6*b* is a view in crosssection of the bag of FIG. 6*a*, along the axis AA illustrated in FIG. 6A.

By way of comparison, as illustrated in FIGS. 6*a* and 6*b*, when the user attempts to open a bag 1 including a hinge (zones 31 or 33) conventionally, the tension force applied to the walls 10, 20 has the effect of causing the closure assembly to rotate and to align it with the direction of application of this force (see the arrows in FIG. 6*b*), or perpendicular to the direction of separation of the closure elements 34 (said separation direction extending perpendicular to the plane of the support webs 30, 32). The result is that the closure elements 34 remain engaged and prevent the opening of the bag 1.

By connected is meant here that the support web 30, 32 is either applied and fixed, for example by welding, on the associated wall, or formed in one piece (i.e. formed integrally and in a single piece) with said wall 10, 20. The welding can be of the heat welding type, ultrasonic welding, for example spot welding, or both (accomplished in succession).

Of course, the first and the second support web 30, 32 can be connected according to identical or different techniques to the associated wall 10, 20: for example, the first support web 30 can be applied and fixed on the first wall 10 while the second support web 32 can be formed in one piece with the second wall 20, or vice versa.

In one embodiment, the passage 40 extends along a substantial height of the first support web 30, so as to allow the user to better block the movements of the first support web 30.

The first support web 30 can for example be divided into several consecutive sections, each corresponding to a portion of the first support web 30 which is welded, or not, to the first wall 10.

Figure 5:
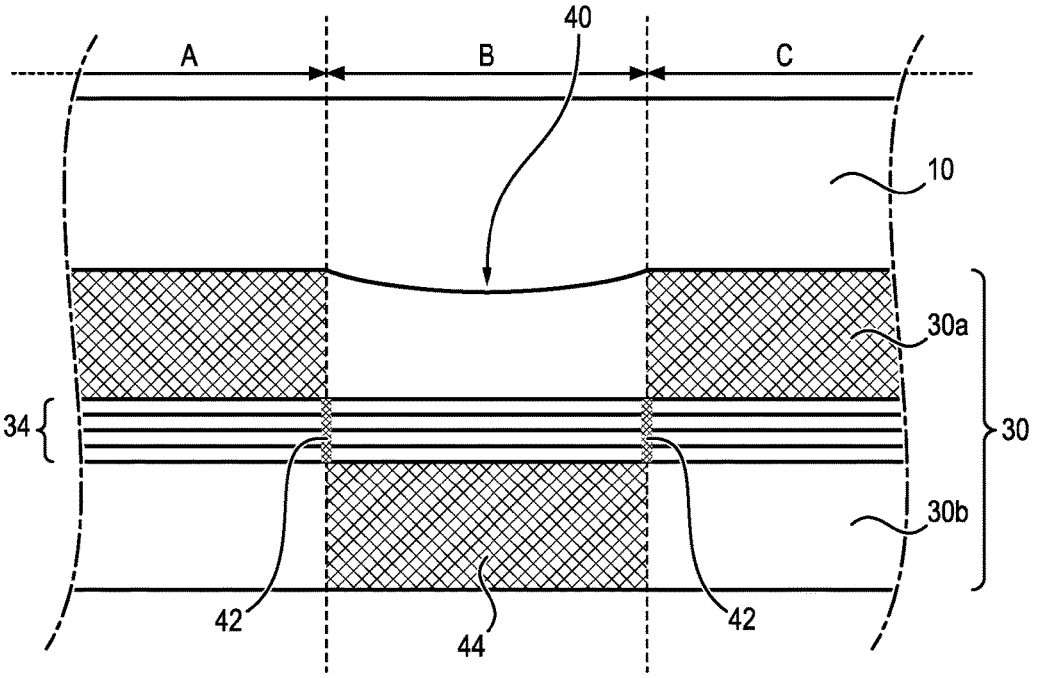
FIG. 5 is a detail view of an embodiment of a passage allowing easy opening of a bag according to the invention.

For example, in an embodiment illustrated in FIG. 5, the first support web 30 can be divided into three sections A, B, C:

a first section A, which extends between one of the lateral edges of the bag 1 and the passage 40, in which the first support web 30 is connected to the first wall 10, a second section B, which extends along the passage 40, in which the first support web 30 is not connected over at least a portion of its height to the first support web 30, so as to provide the passage 40, and a third section C, which extends between the other of the lateral edges of the bag 1 and the passage 40, in which the first support web 30 is connected to the first wall 10.

The first support web 30 is then in fact discontinuously connected over its length to the first wall 10 of the bag 1, because it is not fixed to at least a portion of its height to the first wall 10 along the second section B.

What will be understood here by length is the dimension which extends along the extension direction of the closure assembly 3 and which extends between the lateral sides of the bag 1. Moreover, what will be understood by height is the dimension which extends perpendicular to the extension direction of the closure assembly 3 and which extends between the mouth and the bottom 2 of the bag 1.

It will be understood that the bag 1 can comprise more sections, including two disjoint sections in which the first support web 30 is not connected to the first wall 10 over a portion of its height.

In one embodiment, the passage 40 can extend over the entire height of the upper portion 30*a* of the first support web 30, or possibly to a zone underlying the closure element 34. For this purpose, the upper portion 30*a* of the first support web 30 can be connected to the first wall 10 in the first and third sections A, C, for example by welding, while it is left free (not welded) along the second section B.

As a variant, the upper portion 30*a* of the first support web 30 can comprise a local notch at the second section B and connected to the first wall 10 along the first and second sections A, C. The notch can in particular be obtained by cutting out the upper portion of the first support web 30, at the second section B.

In one embodiment, in order to facilitate the opening of the closure assembly 3, the lower portion 30*b* of the first support web 30 is continuously connected over all or a part of its height to the first wall 10 of the bag 1 in the zone which extends facing the passage 40. This continuous connection of the lower portion 30*b* in the extension of the passage 40 makes it possible to increase the force applied by the first wall 10 to the closure elements 34 in the separation direction, and therefore simplifying their separation and the opening of the closure assembly. In one embodiment, only a lower zone, underlying the closure element 34, of the lower portion 30*b* of the first support web 30 is connected to the first wall 10 (see FIG. 5). In this manner, the user can insert his thumb into the passage beyond the closure element 34, which facilitates the triggering of the separation of the closure elements 34.

Typically, in the embodiment illustrated in FIG. 5, the lower portion 30*b* of the first support web 30 is connected over a portion of its height to the first wall 10 along the second section B (see the hashed zone 44).

Optionally, so as to stiffen the attachment of the lower portion 30*b* of the first support web 30 to the first wall 10, transverse welds 42 can further be carried out at the border between the first and the second section A, B on the one hand and at the border between the second and the third section B, C on the other hand (regardless of the height over which the lower portion 30*b* is welded to the first wall). It will be noted that such transverse welds 42 allow, in addition to stiffening the attachment of the first support web 10, ensuring a seal between the outside and the inside of the bag 1 at the second section B, despite the presence of the passage 40.

At the first and third sections A, C, the lower portion 30*b* can be left free (as illustrated in FIG. 5, on which the hashed zones represent the welded portions of the first support web 30) or continuously connected to the first wall 10 of the bag 1 over all or part of its height, in which case the lower portion is then connected to the lower portion of one lateral side of the bag 1 to the other.

In order to allow the passage 40 of a thumb, preferably of the thumb of an adult, the passage 40 has a length, along the extension direction of the closure assembly 3 between the lateral sides of the bag 1, comprised between 12 mm and 35 mm.

In one embodiment, the passage 40 is closer to one of the sides of the bag 1 than to the other of said sides, so as not to extend centrally. In this manner, the passage 40 is less likely to be stressed during the manipulation of the bag 1. Typically, the edge of the passage 40 can extend to a distance comprised between 10% and 30% of the distance between the lateral sides of the bag 1, i.e. for a bag 1 having a length, between the lateral sides, of 100 mm, the edge of the passage 40 extends to a distance comprised between 10 mm and 30 mm from one of the lateral sides.

In one embodiment, each closure element 34 comprises several complementary profiles, as illustrated in FIGS. 3 to 9, preferably between three and six complementary profiles, five for example.

The presence of several complementary profiles 34 in fact allows facilitating the engagement of the closure assembly 3 from the outer faces of the walls 10, 20 of the bag 1, by reducing the accuracy needed to ensure their closure. Moreover, it ensures better resistance to internal and external stresses of the walls 10, 20 of the bag 1.

The complementary profiles 34 can be of the male/female, male/male (profiles shaped like arrows, as illustrated in the figures), velvet/hook or even complementary hook type.

The complementary profiles 34 can be sequentially altered by forming successive alterations along the complementary profiles 34 in a direction transverse to the support webs. The sequential alterations are local sequential modifications of the complementary profiles 34, which can especially comprise sequential crushings and/or sequential incisions without removal of material (i.e., either only sequential crushings or only sequential incisions, or both sequential crushings and sequential incisions) and/or sequential notches with removal of material. Reference could be made especially to international application EP2012/073186 in the name of the Applicant, which describes exemplary embodiments of sequential alterations.

In one embodiment, all or part of the complementary profiles 34 can comprise the sequential alterations. So, several complementary profiles 34 can comprise sequential alterations while at least one complementary profile 34 can remain intact, or vice versa.

Hereafter, examples of closure assemblies 3 will now be described in relation to the appended FIGS. 1 to 4. These however consist of non limiting embodiments, in that the invention applies to any closure assembly 3 including support webs 30, 32 formed in one piece on the walls 10, 20 of the bag 1 or applied and fixed to said walls 10, 20 including closure elements 34.

In these embodiments, the second support web 32 can be hinged on the second wall 20 so that tension on the walls of the bag 1, when the complementary closure elements 34 are engaged causes rotation of the support webs 30, 32 around said complementary closure elements 34.

According to a first embodiment illustrated in FIG. 1, the second support web 32 is fixed on the second wall 20 in a localized zone 33 which is not superimposed on the closure element 34 and which is offset with respect to said closure element 34, so that the second support web 32 is hinged on the second wall 20. Such an attachment has for example been described in document FR 2 628 067 in the name of the Applicant, the content of which is incorporated here by reference.

As described in document FR 2 628 067, the preceding disposition allows avoiding having the internal pressure of the bag 1 be applied to the closure elements 34 and tend to separate them. In fact, thanks to this disposition, the separation of the walls of the bag 1 (so as to open the latter) leads to a possible pivoting of the support web at the hinge zone formed by its attachment, without risking separation of the closure elements 34.

In document FR 2 628 067, the localized zone extends in the upper portion 32*a* of the second support web 32 so as to avoid the risks of opening of the bag 1 resulting from the internal pressure applied by the content of the bag 1 to the closure assembly 3.

As a variant, the localized zone can extend in the lower portion 32*b* of the second support web 32 so as to prevent the opening of the bag 1 from the outside. To further reduce the possibilities of opening the bag 1, particularly by children, the upper portion 32*a* of the second support web 32 can have a reduced height. In this manner, grasping the second support web 32 would not be possible, thus rendering necessary the use of the passage 40. For example, the height of the second support web 32 can be less than the height of the closure element 34. In one exemplary embodiment, the height of the upper portion of the second support web can be less than or equal to 1 mm.

Figure 2:
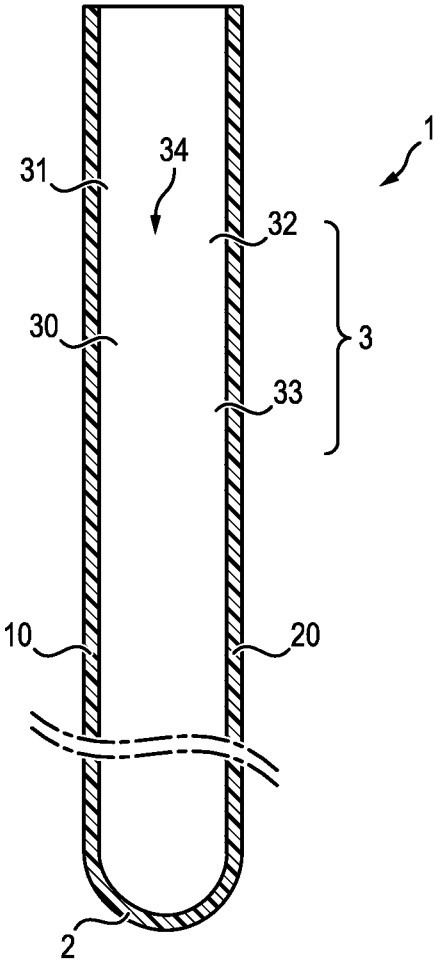
FIG. 2 illustrates a view in transversal crosssection of a second embodiment of a bag according to the invention, the bag being at rest.

According to another variant also illustrated in FIG. 2, the two support webs 30, 32 can be connected to the facing wall 10, 20 at a localized zone 31, 33. The localized zones 31, 33, can be disposed on respective opposite portions of the support webs 30 32 (here the upper portion 30*a* and the lower portion 32*b*), respectively on either side of the complementary closure elements 34, so that one of the hinged webs (here the first support web 30) is directed toward the inside of the bag 1 while the other hinged web (here the second support web 32) is directed toward its mouth. Such a configuration is for example described in the document FR 2 963 927 in the name of the Applicant, the content of which is incorporated here by reference, and illustrated in FIG. 2. Alternatively, the localized zones 31, 33 can be disposed on respective portions of the support webs 30, 32 which extend facing each other, that is on the upper portions 30*a*, 32*a* of the webs 30, 32 or on their lower portions 30*b*, 32*b*.

Figure 3:
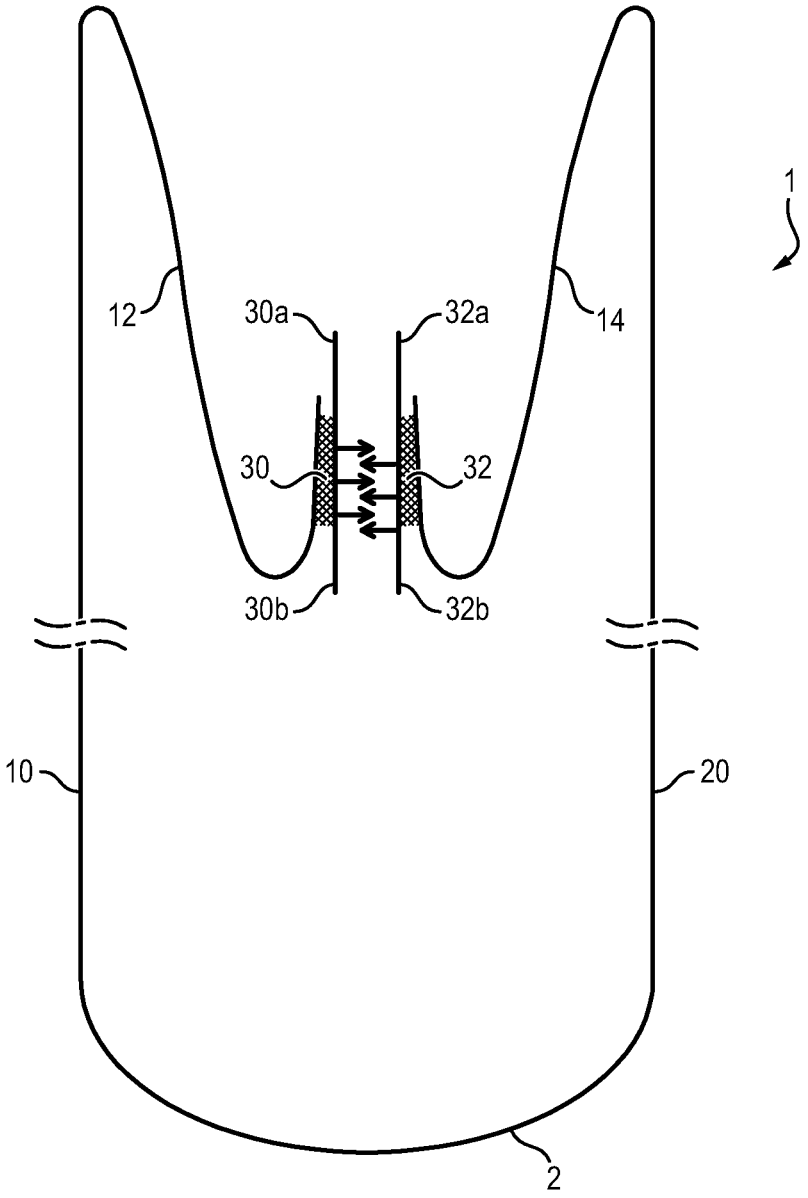
FIG. 3 illustrates a view in transversal crosssection of a third embodiment of a bag according to the invention, the bag being at rest.

According to a second exemplary embodiment illustrated in FIG. 3, the first and the second support web 30, 32 can be connected to the first and the second wall 10, 20 through a first and a second extension web 12, 14, respectively, at least one of the support webs 30, 32 being fixed to the extension web at a distance from its upper portion 30*a*, 32*a*. Such an attachment has for example been described in document FR 14 58288 in the name of the Applicant, the content of which is incorporated here by reference.

In document FR 14 58288, the support web 30, 32 can be fixed to the corresponding extension web 12, 14 in a zone adjacent to the complementary closure element 34 carried by said support web 30, 32. In a variant embodiment, the two support webs 30, 32 are each connected to an associated extension web 12, 14.

Figure 4:
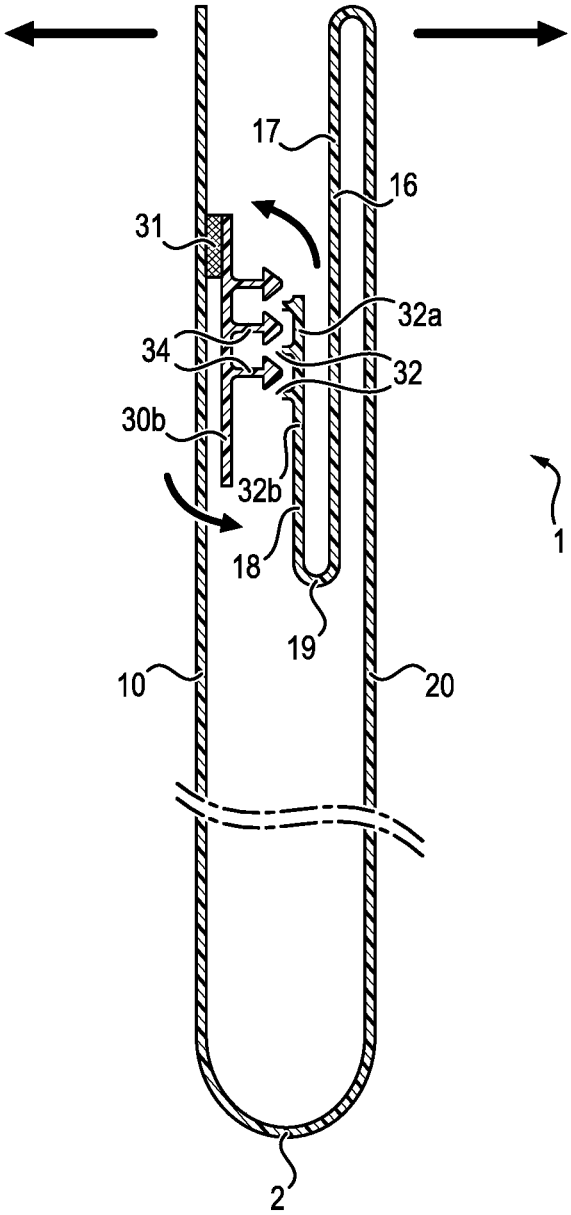
FIG. 4 illustrates a view in transversal crosssection of a fourth embodiment of a bag according to the invention, when the bag is at rest.

According to a third exemplary embodiment illustrated in FIG. 4, the bag 1 further comprises an additional wall 16 having a first panel 17 and a second panel 18. The first panel 17 of the additional wall 16 is connected to the second wall 20 in proximity to the mouth of the bag 1 while the second panel 18 is connected to the first wall 10. The additional wall 16 is folded between the first panel 17 and the second panel 18 along a fold 19 so that the second panel 18 extends towards the mouth. Moreover, the first support web 30 is further fixed on the second wall 20 and the second support web 32 is fixed on the second panel 18 of the additional wall 16. Such an attachment has for example been described in document FR 15 53143 in the name of the Applicant, the content of which is incorporated here by reference.

In document FR 15 53143, the second panel 18 of the additional wall 16 can further be fixed in proximity to the lateral sides of the first wall 10, between the second support web 32 and the fold 19 so as to make the opening of the bag 1 by simple tension on the mouth more difficult.

The walls 10, 20 of the bag 1 can be made of an opaque (non transparent) material, so as to reduce the possibility for children to see the closure assembly 3 through the walls 10, 20.

The walls 10, 20, the support webs 30, 32 and the complementary closure elements 34 can be implemented in only a single material, particularly one of the following materials: polypropylene PP, poly(ethylene terephthalate) PET, polyethylene PE, highdensity polyethylene HDPE, lowdensity polyethylene LDPE and their associated copolymers, ethylene copolymers and/or propylene copolymers.

As a variant, these different elements of the bag 1 can be made of different materials. It is also possible to cite, without limitation, a bag 1 comprising a first wall 10 and a second wall 20 made of poly(ethylene terephthalate) and/or polyethylene and a closure assembly 3 (support webs 30, 32 and complementary closure elements 34) of polypropylene.

Moreover, the first and the second wall 10, 20 can have a thickness comprised between 30 micrometers and 200 micrometers, typically of the order of 60 micrometers to 150 micrometers, especially when said walls are formed from one of the materials described above. It is clear of course that these walls can be made of complex materials comprising several layers of different materials.

The invention claimed is:

1. A bag comprising:

a first and a second wall connected together so as to define lateral sides and a bottom of the bag, a closure assembly comprising a first and a second support web respectively connected to the first and the second wall and each including a complementary closure element, the first support web has an upper edge and a lower edge, the lower edge being closer to the bottom of the bag than the upper edge, the first support web comprising a lower portion and an upper portion, the lower portion being closer to the bottom of the bag than the upper portion, the lower portion carrying the closure element, the lower portion of the first support web comprising the lower edge and the upper portion of the first support web comprising the upper edge, wherein the upper edge is discontinuously connected to the first wall of the bag such that the upper edge of the first support web is continuously fixed on the first wall along a first section and is continuously separated from said first wall along a second section, and the lower portion of the first support web is continuously fixed on the first wall along the second section over all or part of a height of the lower portion, so as to provide at least one passage between this first support web and the first wall of the bag from the outside of the bag, said passage allowing a local deformation of the first support web capable of modifying the local relative orientation of the closure elements during a spacing of the walls of the bag and facilitating the separation of the complementary closure elements; and wherein at least a portion of the first support web is cut out in the second section such that the upper edge of the first support web in the second section is closer to the bottom of the bag than the upper edge of the first support web in the first section.

2. The bag according to claim 1, wherein the lower edge of the first support web is continuously connected to the first wall between the lateral sides of the bag.

3. The bag according to claim 1, wherein the upper portion of the first support web is discontinuously connected to the first wall so as to provide the passage.

4. The bag according to claim 1, wherein the passage has a length, in the direction extending between the sides of the bag, comprised between 12 mm and 35 mm.

5. The bag according to claim 1, wherein the second support web is hinged on the second wall so that tension on the walls of the bag when the complementary closure elements are engaged causes rotation of the support webs around said complementary closure elements.

6. The bag according to claim 5, wherein the second support web is fixed on the second wall in a localized zone which is not superimposed with the closure element and which is offset with respect to said closure element so that the second support web is hinged on the second wall.

7. The bag according to claim 6, wherein the second support web is divided into a lower portion and an upper portion, the lower portion being closer to the bottom than the upper portion and carrying the closure element, and wherein the localized zone at which the second support web is fixed on the second wall is part of the lower portion of said second support web.

8. The bag according to claim 7, wherein the upper portion of the second support web has a height less than a height of the closure element.

9. The bag according to claim 8, wherein the first and the second support web are connected to the first and second walls through a first and a second extension web respectively, at least one of the support webs being fixed to the extension web at a distance from its upper edge.

10. The bag according to claim 9, wherein the at least one support web is fixed to the corresponding extension web in a zone adjacent to the complementary closure element carried by said support web.

11. The bag according to claim 5, further comprising an additional wall having a first panel and a second panel, the first panel being connected to the second wall in proximity to the mouth of the bag while the second panel is connected to the first wall, said additional wall being folded between the first panel and the second panel along a fold so that the first panel extends towards the bottom, and wherein:

the first support web is further fixed on the second wall, and the second support web is further fixed on the second panel of the additional wall.

12. The bag according to claim 11, wherein the second panel of the additional wall is fixed in proximity to the lateral edges of the first wall, between the second support web and the fold.

13. The bag according to claim 11, wherein the second panel of the additional wall is fixed in proximity to the lateral edges of the first wall, between the second support web and the fold.

14. The bag according to claim 1, wherein the complementary closure elements each comprise at least one complementary profile.

15. The bag according to claim 14, wherein all or part of the complementary profiles comprise sequential alterations substantially parallel to the lateral sides.

16. The bag according to claim 15, wherein the sequential alterations comprise sequential crushings.

17. The bag according to claim 1, wherein the complementary closure elements each comprise at least two complementary profiles.

18. The bag according to claim 1, wherein the complementary closure elements each comprise between three and six complementary profiles.

19. A bag comprising:

a first and a second wall connected together so as to define lateral sides and a bottom of the bag, a closure assembly comprising a first and a second support web (30, 32) respectively connected to the first and the second wall and each including a complementary closure element, the first support web has an upper edge and a lower edge, the lower edge being closer to the bottom of the bag than the upper edge, wherein the upper edge is discontinuously connected to the first wall of the bag, wherein the upper edge of the first support web is continuously fixed on the first wall along a first section and is continuously separated from said first wall along a second section, so as to provide at least one passage between this first support web and the first wall of the bag from the outside of the bag, said passage allowing a local deformation of the first support web capable of modifying the local relative orientation of the closure elements during a spacing of the walls of the bag and facilitating the separation of the complementary closure elements, wherein the second support web is hinged on the second wall so that tension on the walls of the bag when the complementary closure elements are engaged causes rotation of the support webs around said complementary closure elements, wherein the bag further comprises an additional wall having a first panel and a second panel, the first panel being connected to the second wall in proximity to the mouth of the bag while the second panel is connected to the first wall, said additional wall being folded between the first panel and the second panel along a fold so that the first panel extends towards the bottom, and wherein:

the first support web is further fixed on the second wall, and the second support web is further fixed on the second panel of the additional wall.

* * * * *